US005242325A

United States Patent [19]

Nukushina

[11] Patent Number: 5,242,325

[45] Date of Patent: Sep. 7, 1993

[54] CONTROL APPARATUS FOR AIR CONDITIONER

[75] Inventor: Harunobu Nukushina, Fuji, Japan

[73] Assignee: Kabushiki Kaisha Toshiba, Kawasaki, Japan

[21] Appl. No.: 914,599

[22] Filed: Jul. 20, 1992

[30] Foreign Application Priority Data

Sep. 19, 1991 [JP] Japan ..... 3-239888

[51] Int. Cl.[5] ..... F24F 13/15

[52] U.S. Cl. ..... 454/285; 454/315

[58] Field of Search ..... 454/256, 285, 313, 315, 454/319, 320, 321

[56] References Cited

FOREIGN PATENT DOCUMENTS

| | | | |
|---|---|---|---|
| 85040 | 5/1983 | Japan | 454/285 |
| 60-40576 | 9/1985 | Japan . | |
| 123250 | 6/1987 | Japan | 454/256 |
| 131153 | 6/1987 | Japan | 454/315 |

*Primary Examiner*—Harold Joyce
*Attorney, Agent, or Firm*—Oblon, Spivak, McClelland, Maier & Neustadt

[57] ABSTRACT

An air conditioner has a body casing provided with an air inlet port and an air blow-off port, a vertical wind shifting element disposed in the body casing for vertically shifting a blow-off direction of wind through the blow-off port, a horizontal wind shifting element disposed in the body casing for horizontally shifting a blow-off direction of wind through a blow-off port and a control apparatus for controlling the vertical and horizontal wind shifting elements. The control apparatus comprises a first driving circuit for driving the vertical wind shifting element, a second driving circuit for driving the horizontal wind shifting element, and a control unit for controlling operations of the first and second driving circuits. A switching circuit for switching operations of the vertical and horizontal wind shifting elements may be further provided. The first driving circuit is controlled to drive the vertical wind shifting element to blow off the wind with a predetermined time interval and the second driving circuit is controlled to drive the horizontal wind shifting element with a predetermined time interval after once fixing the vertical wind shifting element. Thereafter, the vertical wind shifting element is driven to blow out the wind in a mode different from a previous blow-off mode.

14 Claims, 7 Drawing Sheets

CONTROL APPARATUS FOR AIR CONDITIONER

BACKGROUND OF THE INVENTION

The present invention relates to an air conditioner for air conditioning such as room air cooling-heating and dehumidifying control and particularly to a control apparatus for the air conditioner having an improved blowing characteristic of a wind blown out into a room.

In an air conditioner of this kind, cooling air or hot air is blown out of a blow-off port of the air conditioner formed on a body casing thereof, thus serving for air conditioning. On a blow-off port side in the air conditioner, there are provided a vertical wind shifting means for vertically shifting the direction of a blowing wind and a horizontal wind shifting means for horizontally shifting the direction of a blowing wind. The vertical and horizontal wind shifting means generally have structures each incorporated with a stepping motor and a blow-off grille (or wind directioning plate), the blow-off grille being shifted by driving the stepping motor.

A prior art control apparatus for the air conditioner is constructed, wherein stepping motors constituting vertical and horizontal wind shifting means are connected respectively to drive circuits. The drive circuits are controlled for operation each by a control unit such as microcomputer, CPU or the like. The stepping motors are connected to a power unit which is also connected to the control unit. The control unit may be controlled by a remote controller.

In the air conditioner, one driving circuit is provided for corresponding one stepping motor, and when the stepping motors are driven, one driving circuit is operated for one stepping motor. In order to shift the direction of the blown-out wind in both the vertical and horizontal directions, two driving circuits are driven concurrently by the control unit and thus blow-off grilles (louvers) are operated continuously and simultaneously.

In the prior art control apparatus for air conditioner, since two vertical and horizontal wind shifting means are driven concurrently by two driving circuits, respectively, and both the vertical and horizontal blow-off grilles (louvers) are operated continuously at all times, a flow of the wind in a room changes vertically and horizontally in an instable manner in which an arrival distance of the wind blown out of the air conditioner is shortened.

Further, in the prior art control apparatus for air conditioner, since one stepping motor and one driving curcuit are prepared for one blow-off grille and driven concurrently for shifting the wind in both the vertical and horizontal ways, two driving circuits are required for driving the blow-off grille verically and horizontally, thus the number of parts inevitably increasing, and since both the driving circuits are driven concurrently, a large power consumption is entailed, and a power unit gets large in construction, providing a problem.

SUMMARY OF THE INVENTION

An object of the present invention is to substantially eliminate defects and drawbacks encountered in the prior art and to provide a control apparatus for an air conditioner capable of improving a blow-off characteristic of a wind blowen out from a blow-off port of the air conditioner to give comfortable feeling to persons in the room and increasing the arival distance of the wind in a room to effectively heat or cool the room temperature.

Another object of the present invention is to provide a control apparatus for an air conditioner capable of making compact driving means and switching means thereby to save comsuming power and to reduce power load of a power source.

These and other objects can be achieved according to the present invention by providing, in one aspect, a control apparatus for an air conditioner having a body casing provided with an air blow-off port formed on a front portion of the body casing in an installed state and further having a vertical wind shifting means disposed in the body casing for vertically shifting a blow-off direction of wind through the blow-off port, a horizontal wind shifting means disposed in the body casing for horizontally shifting a blow-off direction of eind through the blow-off port and a control apparatus for controlling the vertical and horizontal wind shifting means, the control apparatus comprising:

a first driving means for driving the vertical wind shifting means;

a second driving means for driving the horizontal wind shifting means;

a control unit for controlling operations of the first and second driving means, wherein the first driving means is controlled to change the vertical blow-off direction of the wind through the blow-off port to a direction different from a previous blow-off direction every a predetermined time interval and to fix the vertical blow-off direction and the second driving means is controlled to blow out the wind in the horizontal blow-off direction through the blow-off port.

In this aspect, the horizontal wind shifting means is operated throughout the operation of the air conditioner, but in a modified embodiment, a switching means is further provided for alternately switching operations of the vertical and horizontal wind shifting means in a predetermined time interval.

In another aspect, there is provided a control apparatus for an air conditioner having a body casing provided with an air inlet port and an air blow-off port both formed on a front portion of the body casing in an installed state and further having a vertical wind shifting means disposed in the body casing for vertically shifting a blow-off direction of wind through the blow-off port, a horizontal wind shifting means disposed in the body casing for horizontally shifting a blow-off direction of wind through the blow-off port and a control apparatus for controlling the vertical and horizontal wind shifting means, the vertical and horizontal wind shifting means being operated with predetermined cycles, respectively, the control apparatus comprising:

a first driving means for driving the vertical wind shifting means;

a second driving means for driving the horizontal wind shifting means;

a switching means for switching operations of the vertical and horizontal wind shifting means; and a control unit for controlling operations of the first and second driving means and the switching means, wherein the first driving means is controlled to drive the vertical wind shifting means by a time interval not coincidnent with integral times of one cycle of vertical wind shifting, the second driving means is controlled to drive the horizontal wind shifting means by a time interval longer than half-cycle of horizontal wind shifting after the driving of the first driving means, and the first driving means is then again driven after the driving of the second driving means.

In preferred embodiments, the first and second driving means may be constructed in one unit.

The switching means is disposed between the control unit and the first and second driving means and comprises one common switching circuit for alternately switching the first and second driving means for alternately driving the vertical and horizontal wind shifting means. The switching means may be disposed between the control unit and the vertical and horizontal wind shifting means and comprises one common switching circuit for alternately switching and driving the vertical and horizontal wind shifting means.

According to the characters and structures of the control apparatus for the air conditioner of the present invention, the vertical wind shifting means is fixed by the first driving means after the initial operation period, and then, the horizontal wind shifting means is driven by the second driving means to shift the direction of a blown-out wind horizontally. Therefore, the vertical wind shifting means is driven at a predetermined time interval, and while the vertical wind shifting means is not driven, the horizontal wind shifting means is driven. Thus, the direction of a blown-out wind can be shifted horizontally with the direction of the wind blown out through a blow-off port fixed once vertically, and since the direction of the horizontal wind is shifted with the vertical wind in a room stabilized generally in a flow, a blowing characteristic of the blown-out wind can be improved, and an arrival distance of the blown-out wind can be increased. In consequence, a general room air conditioning such as cooling, heating and the like can be realized efficiently In the control apparatus for air conditioner, a common drive switching circuit may be provided for driving the vertical wind shifting means and the horizontal wind shifting means alternately, and thus the one common drive switching circuit operates for driving the vertical and horizontal wind shifting means alternately, thereby shifting the direction of a wind in two ways vertically and horizontally.

Further, the control apparatus for air conditioner has the drive switching circuit constructed to operate in common, and thus, the single drive switching circuit is sufficient enough to drive both the vertical and horizontal wind shifting means. Therefore, the one driving circuit can be omitted, resulting in a simple construction, and an output burden lightening and a miniature and lightweight construction of the power circuit may be realized by economizing a power consumption.

BRIEF DESCRIPTION OF THE DRAWINGS

For a better understanding of the present invention and to show how the same is carried out, reference will be made, by way of preferred embodiments, to the accompanying drawings, in which.

DESCRIPTION OF THE PREFERRED EMBODIMENTS

Preferred embodiments of the control apparatus for air conditioner according to the present invention will now be described hereunder with reference to the accompanying drawings.

Figure 1:
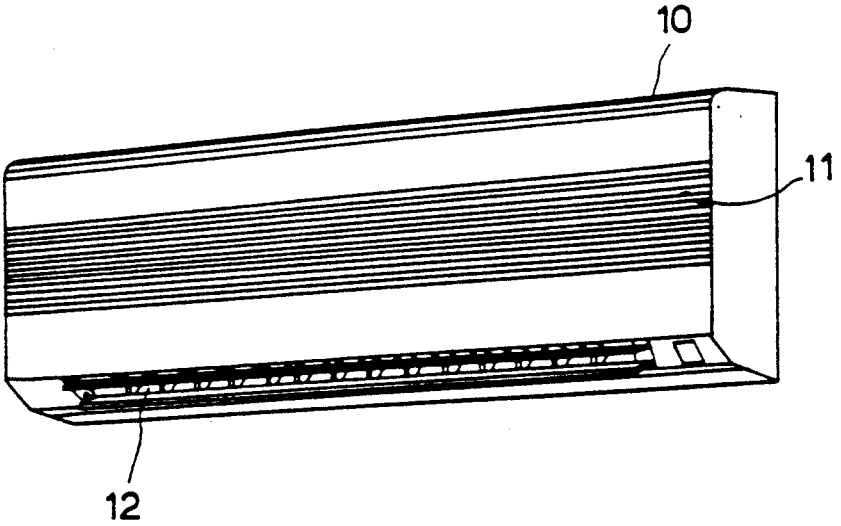
FIG. 1 is a perspective view of a split type air conditioner in an installed state to which present invention is applicable.
Figure 2:
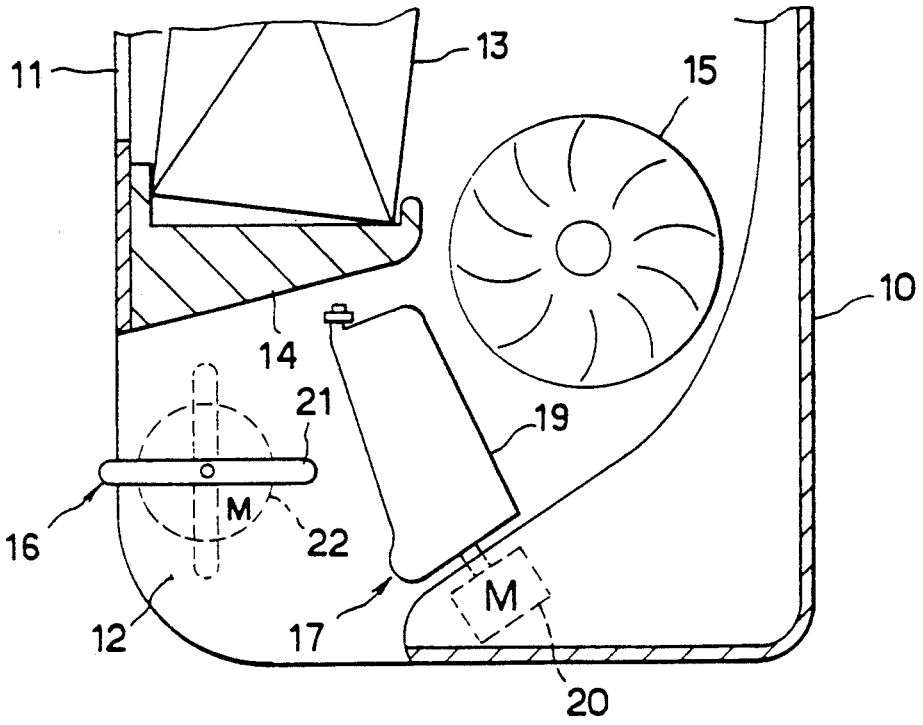
FIG. 2 is a side sectional view of a lower portion of the air conditioner of the type shown in FIG. 1.

FIG. 1 is a perspective view of a split type air conditioner to which the present invention is applicable. The air conditioner has, for example, a wall type body casing 10, and the body casing 10 is provided with an air inlet port 11 and an air blow-off port 12 on its front upper portion and lower portion respectively in an installed state such as shown in FIG. 1. FIG. 2 shows inside of the air conditioner of FIG. 1, in which a room side heat exchanger 13 is provided within the body casing 10 opposite to the inlet port 11, and a drain pan 14 is installed on a lower portion of the room side heat exchanger 13.

A motor-driven room fan 15 is provided on a downstream side of the room side heat exchanger 13, and a room air sucked in from the inlet port 11 by the operation of the room fan 15 is subjected to a heat exchanging operation through the room side heat exchanger 13 to a hot air or cooling air, and is then blown into a room space from the blow-off port 12 on the front lower portion of the body casing 10.

The air conditioner is provided with a vertical wind shifting means 16 for shifting a blown-out wind vertically and a horizontal wind shifting means 17 for shifting the wind horizontally on a blow-off port side of the body casing 10. The horizontal wind shifting means 17 is constructed in combination of a blow-off grille 19 comprising a plurality of louvers linked together and a reversible stepping motor 20. The vertical wind shifting means 16 is also constructed in combination of a blow-off grille 21 and a stepping motor 22.

The vertical and horizontal wind shifting means 16 and 17 are controlled for operation by a control apparatus 25 of the air conditioner. The control apparatus 25 has a control unit 26 constructed of microcomputer, CPU and others. A voltage from a power unit 27 working as a power circuit is impressed on the control unit 26, which may be controlled for operation by a remote controller 28 and others. The remote controller 28a has, for example, a swing button 28a which is operated by depressing the swing button 28a, and when the swing button 28a is once depressed, a swing start command is outputted to the control unit 26, and when depressed again, a swing end command is outputted thereto.

Figure 3:
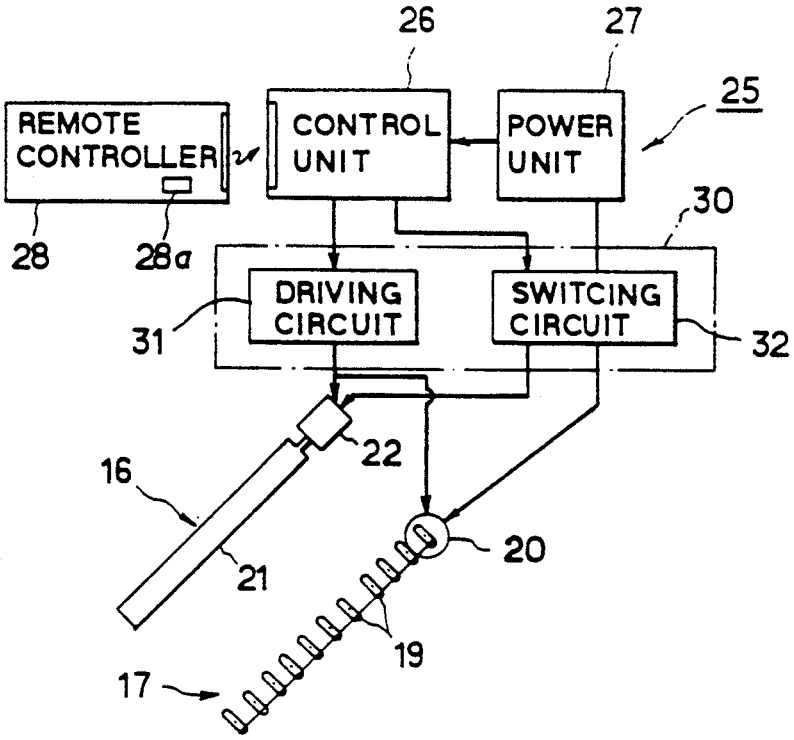
FIG. 3 is a control circuit diagram representing one embodiment of a control apparatus for the air conditioner relating to the present invention.

On the other hand, as shown in FIG. 3, the control unit 26 is connected to a driving circuit 31 and a switching circuit 32 both constructing a drive switching circuit 30, outputting a driving signal to the driving circuit 31 and a switching signal to the switching circuit 32. The driving circuit 31 is connected to the stepping motors 22 and 20 of the vertical and horizontal wind shifting means 16 and 17, respectively, thereby constructing a switching circuit for driving the stepping motors 22 and 20. Further, a power from the power unit 27 is changed alternately by the switching circuit 32, which is then supplied to the stepping motors 22 and 20 alternately.

Figure 4:
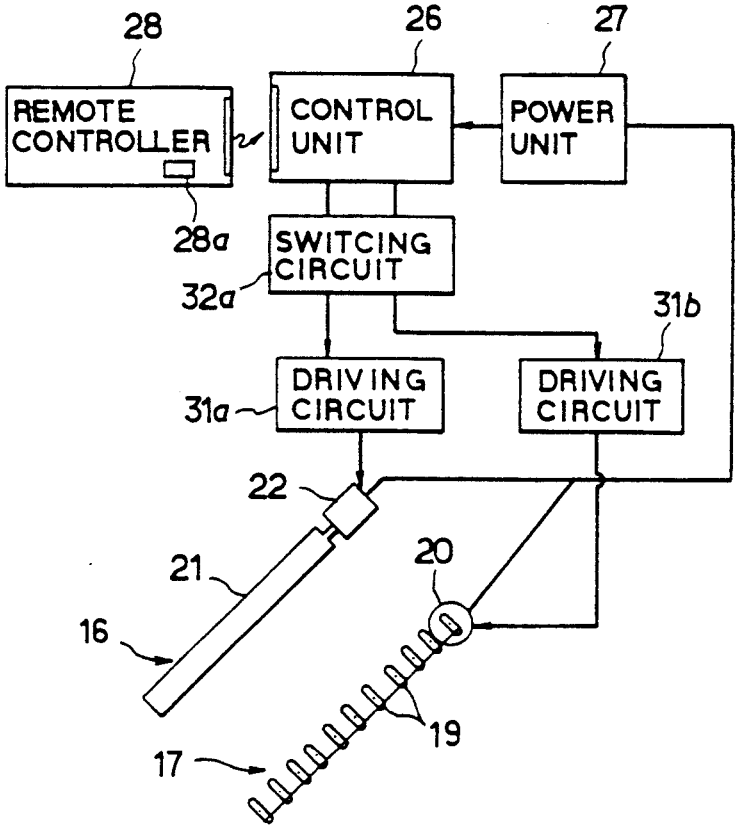
FIG. 4 is a control circuit diagram representing another embodiment according to the present invention.

In another embodiment of the control apparatus 25 of FIG. 4, in which like reference numeral are added to elements or members corresponding to those shown in FIG. 3, the control apparatus 25 of the air conditioner is provided with first driving means 31a for driving the vertical wind shifting means 16 at a predetermined time interval and second driving means 31b for driving the horizontal wind shifting means 17 while the first driving means 31a is stopped according to the control unit 26 and the switching circuit 32a. In this embodiment, the first and second driving means 31a and 31b are constructed separately. In this meaning, the driving means 31 of FIG. 3 is commonly utilized for the first and second driving means 31a and 31b of FIG. 4.

In the embodiment of FIG. 4, the switching circuit 32a may be disposed between the control unit 26 and the first and second driving means 31a and 31b. Such switching circuit 32a may be incorporated in the control unit 26. The first driving means 31a drives the vertical wind shifting means 16 for necessary duration at every predetermined times. The duration is a period of time not coincident with integral times of one period for vertical wind slightly shifting by the vertical wind shifting means 16 for the purpose of eliminating a dead space for the air blowing into the room space and hence to achieve substsntially uniform air blowing. Thus, the wind blown out by operating the vertical wind shifting means 16 is vertically different, i.e. shifted, direction from that of the previous one.

Meanwhile, the second driving means 31b drives the horizontal wind shifting means 17 for necessary duration in the state where the vertical wind shifting means 16 is stopped driving, and the blown-out wind is fixed vertically in direction. It may be preferred that the horizontal wind shifting means 17 is driven by the second driving means 31b for duration not shorter than a half-period of horizontal wind shifting.

An operation of the control apparatus of the air conditioner will be described hereunder.

For cooling-heating operation on the air conditioner, the vertical wind shifting means 16 and the horizontal wind shifting means 17 are respectively controlled for operation by the first driving means 31a and the second driving means 31b of the control apparatus 25.

Figure 5:
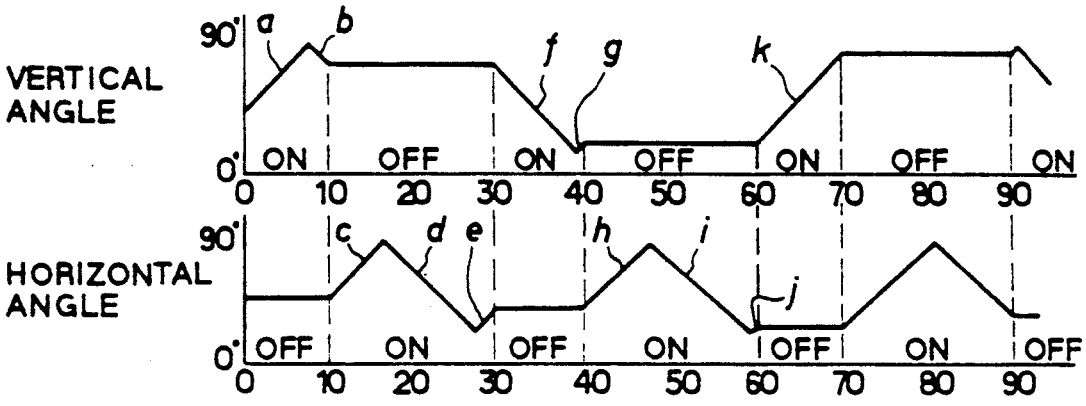
FIG. 5 is an operation timing chart of vertical and horizontal blow-off grilles controlled by the control apparatus for the air conditioner relating to the invention.
Figure 6:
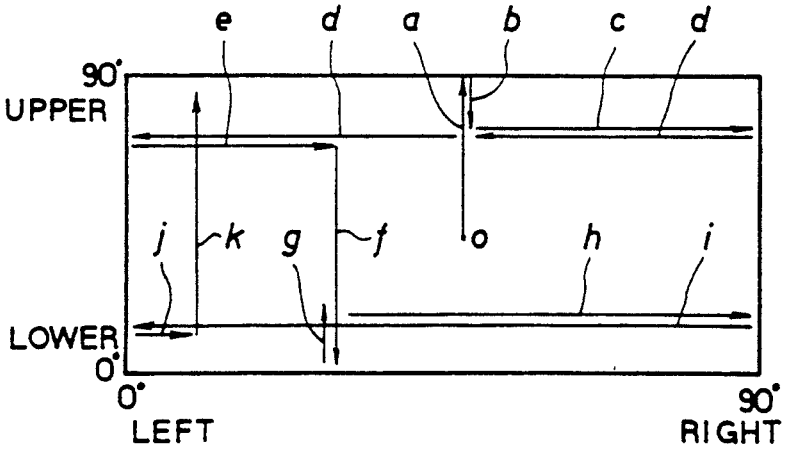
FIG. 6 is an illustration showing a shift of the wind blown out of the air conditioning mode shown in FIG. 5.
Figure 7:
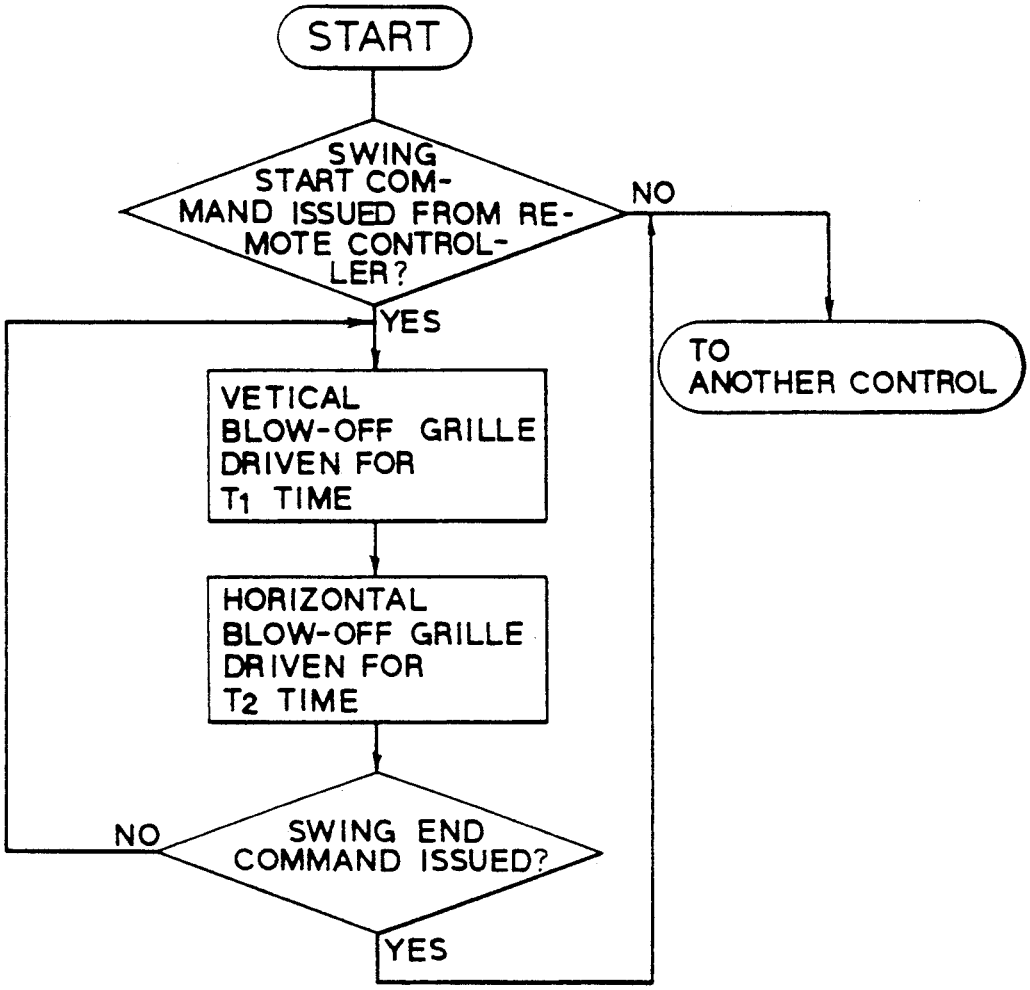
FIG. 7 is a control flowchart showing a control flow of the control apparatus for the air conditioner relating to the present invention.
Figure 8:
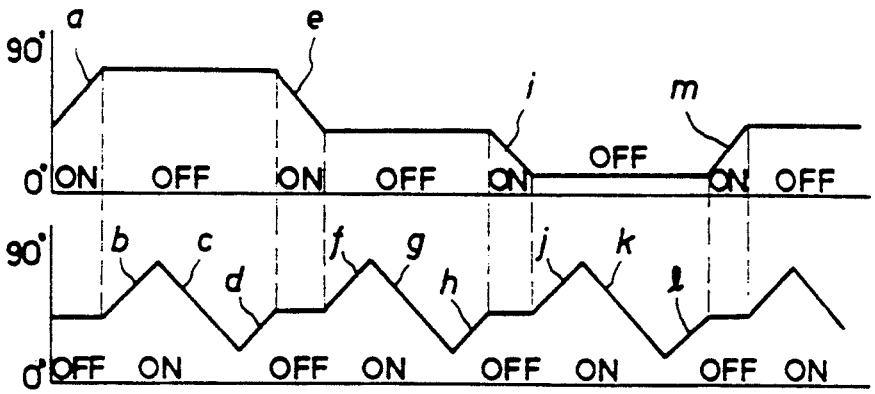
FIG. 8 is an operation timing chart similar to FIG. 5 exemplifying the case where an operation timing of the vertical and horizontal blow-off grilles is switched according to a grille driving angle.

For heating room air, for example, when the blow-off grilles 21 and 19 of the wind shifting means 16 and 17, durations for driving the vertical blow-off grille 21 and the horizontal blow-off grille 19 is determined beforehand, and the vertical blow-off grille 21 and the horizontal blow-off grille 19 are then shifted alternately and selectively at every necessary durations for the predetermined driving time (FIG. 5 and FIG. 8). At least one of the vertical and horizontal blow-off grilles 21 and 19 has its driving time set so that a driving stop position will change not less than about $\frac{1}{4}$ of the whole driving range from a driving start position, and the other driving time is set so that the driving stop position will change not less than about $\frac{2}{3}$ of the whole driving range. In case of less than about $\frac{1}{4}$, there requires much time for one cycle operation, thus being not comfortable for human body in his or her feeling and in case of less than $\frac{2}{3}$, the blown air will not suitably arrive throughout the entire room space. Thus, as shown in FIG. 6, the blown-out wind can be guided throughout the room. Both the blow-off grilles 21 and 19 have their own driving duration sets, for example, not longer than one minute, thus keeping the blown-out wind from coming one-sidedly to a specific portion. In this connection, reference characters a to k, in FIG. 6, correspond respectively to grille angular positions a to k, in FIG. 5, of the vertical blow-off grille 21 and the horizontal blow-off grille 19.

Figure 11:
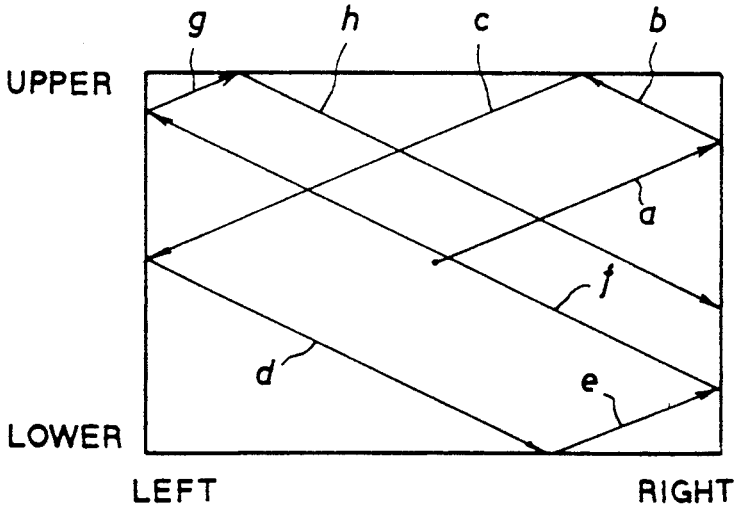
FIG. 11 is an illustration showing a shift of the wind blown out of the air conditioner relating to FIG. 10.

In this regard, the air blow-off condition or mode according to the air conditioner controlled by the conventional control apparatus will be shown in FIGS. 11 and 12, from which it will be understood that a comfortable and suitable air blow cannot be achieved.

Figure 9:
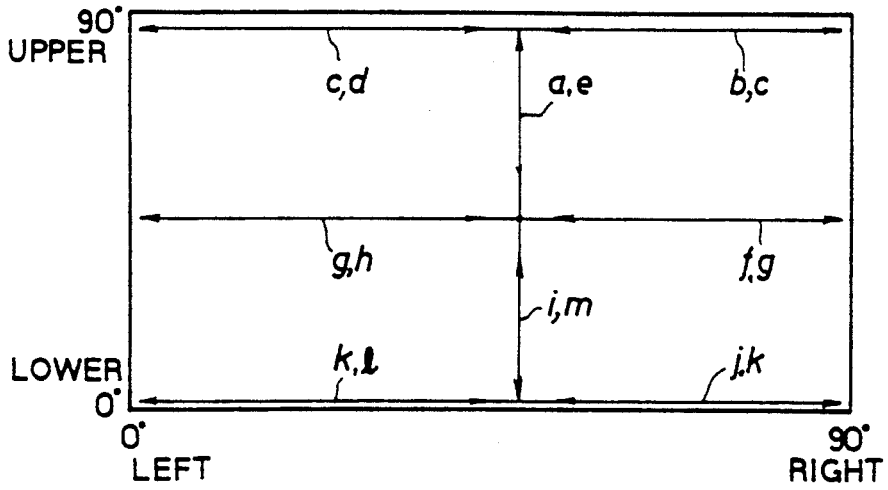
FIG. 9 is an illustration showing a shift of the wind blown out of the air conditioning mode shown in FIG. 8.
Figure 10:
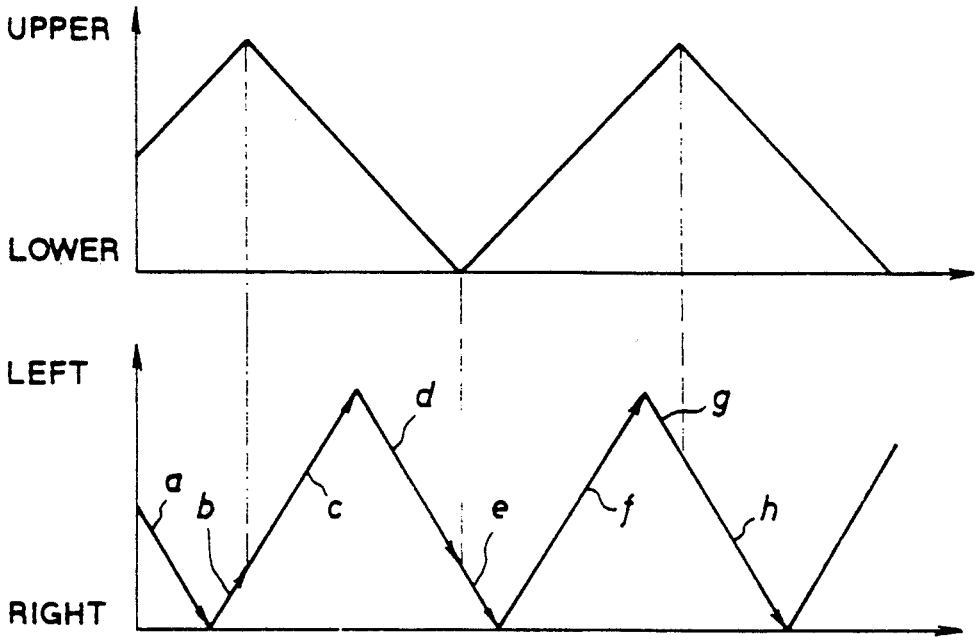
FIG. 10 is an illustration showing an operating relation between vertical and horizontal blow-off grilles controlled by a control apparatus of a conventional structure.

A timing to change the driving of the blow-off grilles 21 and 19 may be otherwise determined according to a grille driving angle, as shown in FIG. 8, instead of the grille driving duration. In this case, at least one of the blow-off grilles 21 and 19 has the grille driving angle set as changing not less than about $\frac{1}{4}$ of the whole driving range from the driving start position to the driving stop position, and the other grille driving angle is set as changing not less than about $\frac{2}{3}$ of the whole driving range, each driving duration being set, for example, to be not longer than one minute. In this case, the blown-out wind can also be guided throughout the room as shown in FIG. 9.

As can be understood form the foregoing descriptions, according to the present invention, in a broder aspect, the switching circuit may be eliminated, and in such aspect, the horizontal wind shifting means will be operated throughout the operation of the air conditioner regardless of the operation of the vertical wind shifting means.

In the control apparatus of the air conditioner of the characters described above, the grille driving duration (grille driving angle) of the vertical blow-off grille 21 and the grille driving duration (grille driving angle) of the horizontal blow-off grille 19 are set beforehand, and the grille driving durations (grille driving angles) are set in the control unit 26. In response to driving signals from the control unit 26, the stepping motors 22 and 20 of the wind shifting means 16 and 17 are set to the driven state through the operation of the driving circuit 31 (31a, 31b). On the other hand, a switching signal from the control unit 26 is inputted to the switching circuit 32 (32a) to switch the switching circuit 32 at every grille driving durations (angles) corresponding to the blow-off grilles 21 and 19, and the stepping motors 22 and 20 are driven each alternately.

In the control apparatus 25, the wind blown out of the blow-off port 12 has its direction shifted by the vertical wind shifting means 16 and the horizontal wind shifting means 17 driven alternately.

In such case, both the vertical and horizontal wind shifting means 16 and 17 are driven alternately by the common drive switching circuit 30. Therefore, when the horizontal wind shifting means 17 is operating, the vertical wind shifting means 16 is kept fixed at some portion vertically.

Figure 12A:
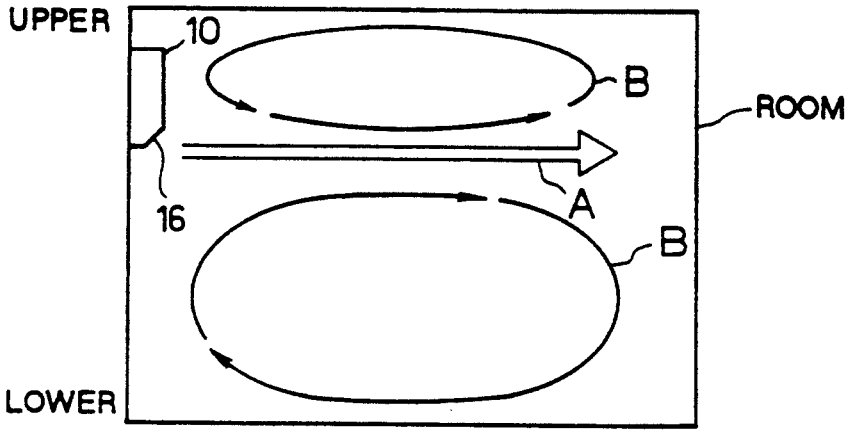
FIGS. 12A and 12B are illustrations showing flows of the wind blown out of the air conditioner which are viewed from the side of a room.
Figure 12B:
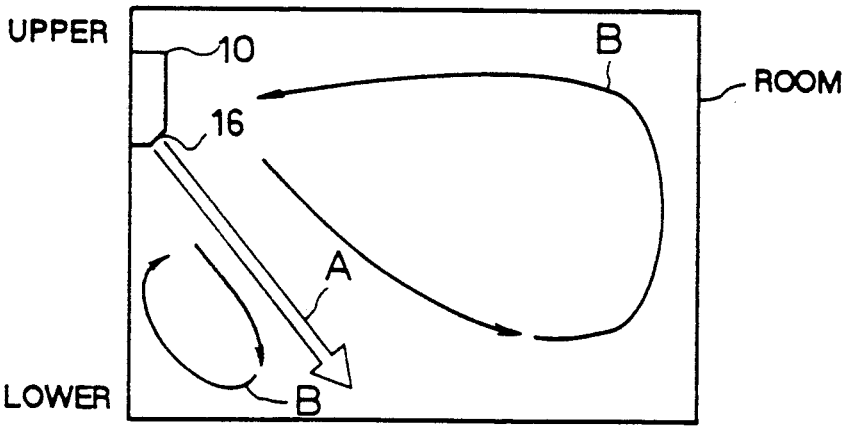

More specifically, in the air conditioner according to the present invention, when the wind blown out horizontally into a room is shifted, the vertical wind is kept unchanged and fixed one-way. When viewed from a side of the room, the blown-out wind flows as shown in FIGS. 12A and 12B, and the wind flowing throughout the room is stabilized as a wind A blowing vertically and a wind B flowing along the wind A.

On the other hand, since the blow-off port 12 of the air conditioner is formed longer horizontally, the vertical wind blown out of the blow-off port 12 forms a blow substantially stabilized throughout the room space. Thus, even by shifting the wind horizontally with a vertical blowing being fixed, the wind can be shifted well horizontally in the blown-out wind stabilized vertically as a flow of the blown-out wind is stabilized vertically.

Accordingly, the room wind is smoothed entirely to flow horizontally in a flow of the stabilized vertical wind without obstructing the horizontal wind. In result, a blowing characteristic of the wind blown out of the air conditioner can be improved, an arrival distance of the blown-out wind or the horizontal wind in particular can be increased, thus realizing an efficient air conditioning such as cooling, heating and the like.

What is claimed is:

1. A control apparatus for an air conditioner having a body casing provided with an air blow-off port formed on a front portion of the body casing in an installed state and further having a vertical wind shifting means disposed in the body casing for vertically shifting a blow-off direction of wind through the blow-off port, a horizontal wind shifting means disposed in the body casing for horizontally shifting a blow-off direction of wind through the blow-off port and a control apparatus for controlling the vertical and horizontal wind shifting means, said control apparatus comprising:

a first driving means for driving the vertical wind shifting means;

a second driving means for driving the horizontal wind shifting means; and a control unit for controlling operations of the first and second driving means, wherein the first driving means is controlled to change the vertical blow-off direction of the wind through the blow-off port to a direction different from a previous blow-off direction every a predetermined time interval and to fix the vertical blow-off direction and the second driving means is controlled to blow out the wind in the horizontal blow-off direction through the blow-off port.

2. A control apparatus according to claim 1, wherein said horizontal driving means is operated throughout the operation of an air conditioner for horizontally shifting the blow-off direction of the wind.

3. A control apparatus for an air conditioner having a body caing provided with an air blow-off port formed on a front portion of the body casing in an installed state and further having a vertical wind shifting means disposed in the body casing for vertically shifting a blow-off direction of wind through the blow-off port, a horizontal wind shifting means disposed in the body casing for horizontally shifting a blow-off direction of wind through the blow-off port and a control apparatus for controlling the vertical and horizontal wind shifting means, said control apparatus comprising:

a first driving means for driving the vertical wind shifting means;

a second driving means for driving the horizontal wind shifting means;

a switching means for switching operations of the vertical and horizontal wind shifting means; and a control unit for controlling operations of the first and second driving means and the switching means, wherein the first driving means is controlled to change the vertical blow-off direction of the wind through the blow-off port to a direction different from a previous blow-off direction every a predetermined time interval and to fix the vertical blow-off direction and the second driving means is then controlled to change the horizontal blow-off direction of the wind through the blow-off port.

4. A control apparatus according to claim 3, wherein said first and second driving means are constructed in one unit.

5. A control apparatus according to claim 3, wherein said switching means is disposed between the control unit and the first and second driving means and comprises one common switching circuit for alternately switching the first and second driving means for alternately driving the vertical and horizontal wind shifting means.

6. A control unit according to claim 5, wherein said switching means in incorporated in the control unit.

7. A control apparatus according to claim 3, wherein said switching means is disposed between the control unit and the vertical and horizontal wind shifting means and comprises one common switching circuit for alternately switching and driving the vertical and horizontal wind shifting means.

8. A control unit according to claim 7, wherein said switching means in incorporated in the control unit.

9. A control apparatus for an air conditioner having a body casing provided with an air blow-off port formed on a front portion of the body casing in an installed state and further having a vertical wind shifting means disposed in the body casing for vertically shifting a blow-off direction of wind through the blow-off port, a horizontal wind shifting means disposed in the body casing for horizontally shifting a blow-off direction of wind through the blow-off port and a control apparatus for controlling the vertical and horizontal wind shifting means, said vertical and horizontal wind shifting means being operated with predetermined cycles, respectively, said control apparatus comprising:

a first driving means for driving the vertical wind shifting means;

a second driving means for driving the horizontal wind shifting means;

a switching means for switching operations of the vertical and horizontal wind shifting means; and a control unit for controlling operations of the first and second driving means and the switching means, wherein the first driving means is controlled to drive the vertical wind shifting means by a time interval not coincident with integral times of one cycle of vertical wind shifting, the second driving means is controlled to drive the horizontal wind shifting means by a time interval longer than half-cycle of horizontal wind shifting after the driving of the first driving means, and the first driving means is then again driven after the driving of the second driving means.

10. A control apparatus according to claim 9, wherein said first and second driving means are constructed in one unit.

11. A control apparatus according to claim 9, wherein said switching means is disposed between the control unit and the first and second driving means and comprises one common switching circuit for alternately switching the first and second driving means for alternately driving the vertical and horizontal wind shifting means.

12. A control unit according to claim 10, wherein said switching means in incorporated in the control unit.

13. A control apparatus according to claim 9, wherein said switching means is disposed between the control unit and the vertical and horizontal wind shifting means and comprises one common switching circuit for alternately switching and driving the vertical and horizontal wind shifting means.

14. A control unit according to claim 13, wherein said switching means in incorporated in the control unit.

* * * * *